US006299801B1

(12) United States Patent
Handa et al.

(10) Patent No.: US 6,299,801 B1
(45) Date of Patent: Oct. 9, 2001

(54) ORGANIC POSITIVE TEMPERATURE COEFFICIENT THERMISTOR

(75) Inventors: Tokuhiko Handa; Yukie Yoshinari, both of Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 09/238,921

(22) Filed: Jan. 28, 1999

(30) Foreign Application Priority Data

Nov. 2, 1998 (JP) ..... 10-327503

(51) Int. Cl.[7] ..... H21B 1/06

(52) U.S. Cl. ..... 252/511; 252/500; 252/510; 252/511; 252/512; 252/513; 252/518.1; 219/541; 219/546; 219/547; 219/553; 264/104; 264/105; 264/234; 264/347

(58) Field of Search ..... 252/510, 511, 252/512, 513, 518.1; 219/541, 546, 547, 553; 264/104, 105, 234; 338/22 R

(56) References Cited

U.S. PATENT DOCUMENTS 5,378,407 * 1/1995 Chandler et al. ..... 252/513
5,945,034 * 8/1999 Handa et al. ..... 252/511
5,982,271 * 11/1999 Handa et al. ..... 338/22 R
6,090,314 * 7/2000 Handa et al. ..... 252/511

FOREIGN PATENT DOCUMENTS 5-47503 2/1993 (JP) .

OTHER PUBLICATIONS

Kazuyuki Ohe, et al., "A New Resistor Having an Anomalously Large Positive Temperature Coefficient", Japanese Journal of Applied Physics, vol. 10, No. 1, Jan., 1971, pp. 99–108.

* cited by examiner

*Primary Examiner*—Yogendra Gupta
*Assistant Examiner*—Derrick G. Hamlin
(74) *Attorney, Agent, or Firm*—Oblon, Spivak, McClelland, Maier & Neustadt, P.C.

(57) ABSTRACT

The invention provides an organic positive temperature coefficient thermistor comprising at least two polymer matrices, a low-molecular organic compound and a conductive particle having spiky protuberances. For the polymer matrices, at least two thermoplastic polymer matrices having varying melting points or at least one thermoplastic polymer matrix and at least one thermosetting polymer matrix are used. It is thus possible to provide an organic positive temperature coefficient thermistor which has sufficiently low room-temperature resistance and a large rate of resistance change between an operating state and a non-operating state, and can operate with a reduced temperature vs. resistance curve hysteresis, ease of control of operating temperature, and high performance stability.

19 Claims, 5 Drawing Sheets

ORGANIC POSITIVE TEMPERATURE COEFFICIENT THERMISTOR

BACKGROUND OF THE INVENTION

1. Prior Art

The present invention relates to an organic positive temperature coefficient thermistor that is used as a temperature sensor or overcurrent-protecting element, and has PTC (positive temperature coefficient of resistivity) characteristics or performance that its resistance value increases with increasing temperature.

2. Background Art

An organic positive temperature coefficient thermistor having conductive particles dispersed in a crystalline thermoplastic polymer has been well known in the art, as typically disclosed in U.S. Pat. Nos. 3,243,753 and 3,351,882. The increase in the resistance value is thought of as being due to the expansion of the crystalline polymer upon melting, which in turn cleaves a current-carrying path formed by the conductive fine particles.

An organic positive temperature coefficient thermistor can be used as a self control heater, an overcurrent-protecting element, and a temperature sensor. Requirements for these are that the resistance value is sufficiently low at room temperature in a non-operating state, the rate of change between the room-temperature resistance value and the resistance value in operation is sufficiently large, and the resistance value change upon repetitive operations is reduced.

To meet such requirements, it has been proposed to use a low-molecular organic compound such as wax and employ a thermoplastic polymer matrix for a binder. Such an organic positive temperature coefficient thermistor, for instance, includes a polyisobutylene/paraffin wax/carbon black system (F. Bueche, J. Appl. Phys., 44, 532, 1973), a styrene-butadiene rubber/paraffin wax/carbon black system (F. Bueche, J. Polymer Sci., 11, 1319, 1973), and a low-density polyethylene/paraffin wax/carbon black system (K. Ohe et al., Jpn. J. Appl. Phys., 10, 99, 1971). Self control heaters, current-limiting elements, etc. comprising an organic positive temperature coefficient thermistor using a low-molecular organic compound are also disclosed in JP-B's 62-16523, 7-109786 and 7-48396, and JP-A's 62-51184, 62-51185, 62-51186, 62-51187, 1-231284, 3-132001, 9-27383 and 9-69410. In these cases, the resistance value increase is believed to be due to the melting of the low-molecular organic compound.

One of advantages to the use of the low-molecular organic compound is that there is a sharp rise in the resistance increase with increasing temperature because the low-molecular organic compound is generally higher in crystallinity than a polymer. A polymer, because of being easily put into an over-cooled state, shows a hysteresis where the temperature at which there is a resistance decrease with decreasing temperature is usually lower than the temperature at which there is a resistance increase with increasing temperature. With the low-molecular organic compound it is then possible to keep this hysteresis small. By use of low-molecular organic compounds having different melting points, it is possible to easily control the temperature (operating temperature) at which there is a resistance increase. A polymer is susceptible to a melting point change depending on a difference in molecular weight and crystallinity, and its copolymerization with a comonomer, resulting in a variation in the crystallographic state. In this case, no sufficient PTC characteristics are often obtained.

This is particular true of when the operating temperature is set at 100° C. or lower.

In the organic positive temperature coefficient thermistors set forth in the above publications, however, no sensible tradeoff between low initial (room temperature) resistance and a large rate of resistance change is reached. pn. J. Appl. Phys., 10, 99, 1971 shows an example wherein the specific resistance value (Ω·cm) increases by a factor of $10^8$. However, the specific resistance value at room temperature is as high as $10^4$ Ω·cm, and so is impractical for an overcurrent-protecting element or temperature sensor in particular. Other publications show resistance value (Ω) or specific resistance value (Ω·cm) increases in the range between 10 times or lower and about $10^4$ times, with the room-temperature resistance being not fully decreased.

On the other hand, JP-A's 2-156502, 2-230684, 3-132001 and 3-205777 disclose an organic positive temperature coefficient thermistor using a low-molecular organic compound and a thermosetting polymer behaving as a matrix. Since carbon black, and graphite are used as conductive particles, however, the rate of resistance change is as small as one order of magnitude or less and the room-temperature resistance is not sufficiently reduced or about 1Ω·cm as well. Thus, no compromise is made between the low initial resistance and the large rate of resistance change.

JP-A's 55-68075, 58-34901, 63-170902, 2-33881, 9-9482 and 10-4002, and U.S. Pat. No. 4,966,729 propose an organic positive temperature coefficient thermistor constructed solely of a thermosetting polymer and conductive particles without recourse to a low-molecular organic compound. In these themistors, either, no compromise is achieved between a room-temperature resistance of up to 0.1 Ω·cm and a large rate of resistance change of 5 orders of magnitude greater, because carbon black, and graphite are used as the conductive particles. Generally, thermistor systems composed merely of a thermosetting polymer and conductive particles have no distinct melting point, and so many of them show a sluggish resistance rise in temperature vs. resistance performance, failing to provide satisfactory performance in overcurrent-protecting element, temperature sensor, and like applications in particular.

In many cases, carbon black, and graphite have been used as conductive particles in prior art organic positive temperature coefficient thermistors including those set forth in the above publications. A problem with carbon black is, however, that when an increased amount of carbon black is used to lower the initial resistance value, no sufficient rate of resistance change is obtainable; no reasonable tradeoff between low initial resistance and a large rate of resistance change is obtainable. Sometimes, particles of generally available metals are used as conductive particles. In this case, too, it is difficult to arrive at a sensible tradeoff between the low initial resistance and the large rate of resistance change.

In Japanese Patent Application No. 9-350108, the inventors have already come up with an organic positive temperature coefficient thermistor comprising a thermoplastic polymer matrix, a low-molecular organic compound and a conductive particle having spiky protuberances. This thermistor has a sufficiently low room-temperature specific resistance of $8\times10^{-2}$ Ω·cm, a rate of resistance change of eleven orders of magnitude greater between an operating state and a non-operating state, and a reduced temperature vs. resistance curve hysteresis. In addition, the operating temperature is 40° C. to 100° C. inclusive. When thermistors are used as protective elements for secondary batteries, electric blankets, heaters for lavatory seats and vehicle seats, etc., an operating temperature of 100° C. or greater poses a potential danger to the human body. With the safety of the human body in mind, the operating temperature must be 100° C. or lower. In recent years, organic positive temperature coefficient thermistors have been increasingly demanded as over-current protecting elements for portable telephones, personal computers, etc. In view of the temperature at which they are used, too, thermistors having an operating temperature from 40° C. to 100° C. are desired.

However, this thermistor is found to be insufficient in terms of performance stability, especially with a noticeably increased resistance at high temperature or humidity or upon exposure to on-off loading. This appears to be due to the segregation, etc. of the working or active substance, i.e., the low-molecular organic compound upon repetitive melting/solidification cycles during operation, which segregation is ascribable to the low melting point and low melt viscosity (about 2 to 10 $mm^2$/sec. at 100° C.) of the low-molecular organic compound. This in turn causes a change in the crystallographic or dispersion state of the low-molecular organic compound and conductive particles, resulting in a performance drop. Such a performance stability problem is important to the low-molecular organic compound acting as the working substance. All currently available thermistors using low-molecular organic compounds as active substances, inclusive of those mentioned above, are still less than satisfactory in terms of performance stability. In some cases, the thermistor elements undergo deformation.

On the other hand, JP-A 5-47503 discloses an organic positive temperature coefficient thermistor comprising a crystalline polymer, for instance, polyvinylidene fluoride and a conductive particle having spiky particles, for instance, spiky Ni powders. U.S. Pat. No. 5,378,407, too, discloses a thermistor comprising filamentary nickel having spiky protuberances, and a polyolefin, olefinic copolymer or fluoropolymer. However, these thermistors are still insufficient in terms of hysteresis and so are unsuitable for applications such as temperature sensors, although the effect on the tradeoff between low initial resistance and a large resistance change is improved. This is because no low-molecular organic compound is used as a working or active substance. Another problem with these thermistors is that when they are further heated after resistance increases upon operation, they show NTC (negative temperature coefficient of resistivity) behavior that the resistance value decreases with increasing temperature. It is to be noted that the above publications give no suggestion about the use of a low-molecular organic compound at all. To add to this, these thermistors have an operating temperature in excess of 100° C. Some thermistors disclosed in the above publications have an operating temperature of 60 to 70° C., but their performance becomes unstable upon repetitive operations.

JP-A 5-198403 and 5-198404 disclose an organic positive temperature coefficient thermistor comprising a mixture of a thermosetting resin and conductive particles having spiky protuberances, and show that the rate of change resistance obtained is 9 orders of magnitude greater. However, when the room-temperature resistance value is lowered by increasing the amount of a filler, no sufficient rate of resistance change is obtained. Thus, it is difficult to achieve a tradeoff between low initial resistance value and a large resistance change. Also, the thermistors fail to show a sufficiently sharp resistance rise because of being composed of the thermosetting resin and conductive particles. The above publications, too, are silent about the use of a low-molecular compound.

Never until now is an organic positive temperature coefficient thermistor obtained, which shows satisfactory performance at an operating temperature of 100° C. or lower and has performance stability.

SUMMARY OF THE INVENTION

An object of the invention is to provide an organic positive temperature coefficient thermistor that has sufficiently low resistance at room temperature and a large rate of resistance change between an operating state and a non-operating state, and can operate at 100° C. or lower, with a reduced temperature vs. resistance curve hysteresis, ease of control of operating temperature, and high performance stability.

Such an object is achieved by the inventions defined below.

(1) An organic positive temperature coefficient thermistor comprising at least two polymer matrices, a low-molecular organic compound and conductive particles, each having spiky protuberances.

(2) The organic positive temperature coefficient thermistor according to (1), wherein said at least two polymer matrices comprise at least one thermoplastic polymer matrix and at least one thermosetting polymer matrix.

(3) The organic positive temperature coefficient thermistor according to (2), wherein said thermosetting polymer matrix is any one of an epoxy resin, an unsaturated polyester resin, a polyimide, a polyurethane, a phenol resin, and a silicone resin.

(4) The organic positive temperature coefficient thermistor according to (1), wherein said at least two polymer matrices comprise at least two thermoplastic polymer matrices having varying melting points.

(5) The organic positive temperature coefficient thermistor according to (4), wherein of said thermoplastic polymer matrices, a thermoplastic polymer matrix having the lowest melting point is higher in melting point than said low-molecular organic compound by at least 15° C.

(6) The organic positive temperature coefficient thermistor according to (4), wherein of said thermoplastic polymer matrices, said thermoplastic polymer matrix having the lowest melting point has a melt flow rate of 1 to 20 g/10 min.

(7) The organic positive temperature coefficient thermistor according to (4), wherein said thermoplastic polymer matrices are polyolefins.

(8) The organic positive temperature coefficient thermistor according to (4), wherein of said thermoplastic polymer matrices, said thermoplastic polymer matrix having the lowest melting point is a low-density polyethylene.

(9) The organic positive temperature coefficient thermistor according to (4), wherein said thermoplastic polymer matrices comprises a high-density polyethylene.

(10) The organic positive temperature coefficient thermistor according to (4), wherein of said thermoplastic polymer matrices, a weight ratio between a thermoplastic polymer matrix except said thermoplastic polymer matrix having the lowest melting point and said thermoplastic polymer matrix having the lowest melting point is 1:4 to 9:1.

(11) The organic positive temperature coefficient thermistor according to (2), wherein a weight ratio between said thermosetting polymer matrix and said thermoplastic polymer matrix is 1:4 to 9:1.

(12) The organic positive temperature coefficient thermistor according to (1), wherein said low-molecular organic compound has a melting point of 40 to 200° C.

(13) The organic positive temperature coefficient thermistor according to (1), wherein said low-molecular organic compound has a molecular weight of 2,000 or lower.

(14) The organic positive temperature coefficient thermistor according to (1), wherein said low-molecular organic compound is a petroleum wax.

(15) The organic positive temperature coefficient thermistor according to (1), wherein a weight of said low-molecular organic compound is 0.2 to 2.5 times as large as a total weight of said polymer matrices.

(16) The organic positive temperature coefficient thermistor according to (1), wherein said conductive particles, each having spiky protuberances, are interconnected in a chain form.

(17) The organic positive temperature coefficient thermistor according to (1), wherein a mixture of said polymer matrices, said low-molecular organic compound and said conductive particles having spiky protuberances is crosslinked together with a silane coupling agent comprising a vinyl group and/or a (meth)acryloyl group and an alkoxy group.

(18) The organic positive temperature coefficient thermistor according to (17), wherein said silane coupling agent is vinyltrimethoxysilane or vinyltriethoxysilane.

(19) The organic positive temperature coefficient thermistor according to (1), which has an operating temperature of 100° C. or lower.

ACTION

The organic positive temperature coefficient thermistor of the invention comprises at least two polymer matrices, a low-molecular organic compound and conductive particles having spiky protuberances. For the polymer matrices at least two thermoplastic polymer matrices having varying melting points are used. Alternatively, at least one thermoplastic polymer matrix and at least one thermosetting polymer matrix are used.

In the present invention, the spiky shape of protuberances on the conductive particles enables a tunnel current to pass readily through the thermistor, and makes it possible to obtain room-temperature resistance lower than would be possible with spherical conductive particles. When the thermistor is in operation, a large resistance change is obtainable because spaces between the spiky conductive particles are larger than those between spherical conductive particles.

In the present invention, the low-molecular organic compound is incorporated in the thermistor so that the PTC performance that the resistance value increases with increasing temperature is achieved by the melting of the low-molecular organic compound. Accordingly, the temperature vs. resistance curve hysteresis can be more reduced than that obtained by the melting of a thermoplastic polymer used as an active substance. Control of operating temperature by use of low-molecular organic compounds having varying melting points, etc. is easier than control of operating temperature making use of a change in the melting point of a polymer. In addition, the present invention enables the thermistor to have an operating temperature of 200° C. or lower, and preferably 100° C. or lower by using as the working or active substance a low-molecular organic compound having a melting point of 40 to 200° C., and preferably 40 to 100° C. Unlike a thermistor using a thermosetting polymer as the working or active substance, the thermistor of the invention shows a sharp resistance rise upon put in operation.

Further, the present invention uses at least two polymer matrices. A thermistor element composed only of a low-molecular organic compound and conductive particles cannot retain shape upon operation because the melt viscosity of the low-molecular organic compound is low. By use of the polymer matrices, it is possible to prevent fluidization of the low-molecular organic compound due to its melting when the thermistor element is in operation or prevent deformation of the thermistor element upon operation. By using at least two polymer matrices, for instance, at least two thermoplastic polymer matrices having varying melting points or at least one thermoplastic polymer matrix and at least one thermosetting polymer matrix, it is also possible to make a great improvement in performance stability, and maintain low room-temperature resistance and a large resistance change upon operation in a stable manner for an extended period of time. This effect becomes particularly noticeable in accelerated testing at high temperature and humidity, and on-off load testing.

In the invention, the large resistance change is obtained making use of a large volume expansion of the low-molecular organic compound incidental to its melting. In the absence of the polymer matrices, however, the element undergoes large deformation even in one operation because the low-molecular organic compound is easily fluidized because of its too low a melt viscosity. For this reason, the low-molecular organic compound is dispersed in the crosslinked polymer matrices that have a melting point higher than that of the low-molecular organic compound or is unsoluble and infusible, thereby preventing thermal deformation.

It is here to be noted that the electrical properties of a thermistor element are largely affected by the thermal physical properties of the polymer matrices. In a system comprising high-density polyethylene suitable for them high-melting thermoplastic polymer matrix in the invention, a low-molecular organic compound and conductive particles, for instance, low room-temperature resistance is obtained with a large resistance change. Even upon repetitive operations, this room-temperature resistance is kept low. When a thermistor element based on this system is further heated after resistance increases, however, there is found an NTC phenomenon in which the resistance value decreases with increasing temperature. Upon cooling, the thermistor shows a large temperature vs. resistance curve hysteresis in which the resistance decreases from a temperature higher than the melting point of the low-molecular organic compound. The fact that a thermistor is restored in resistance value at a temperature higher than the preset temperature can become a serious problem when it is used especially as a protective element. The NTC phenomenon is also found in a system using a thermoplastic resin and conductive particles. The resistance decrease appears to be because of the realignment of the conductive particles in the matrix in a molten state by a current continuing to pass through the thermistor even after resistance increases. The same reason may also hold for the case where, upon cooling, the resistance value decreases from a temperature higher than the operating temperature upon heating. The low-molecular organic compound is dispersed in the high-density polyethylene. However, it appears that when the low-molecular organic compound melts upon operation, the realignment of the conductive particles dispersed therein occurs readily because its melt viscosity is low.

In a system comprising a low-molecular organic compound, a low-melting polyolefin having a melting point relatively close to that of the low-molecular organic compound, for instance, low-density polyethylene and conductive particles, on the other hand, there is a striking room-temperature resistance increase upon repetitive operations. Them low-melting polyolefin melts partly upon operation in which the low-molecular organic compound melts, because the melting point thereof is close to that of the low-molecular organic compound. The low-melting polyolefin, because of containing many side chains and being a copolymer, requires a longer crystallization time as compared with a homopolymer having no side chain. The once molten polyolefin cannot be crystallized to a sufficient level even after solidification, and so contain some amorphous portions. In other words, the system remains expanded as a whole. This appears to cause a gradual room-temperature resistance increase upon repetitive operations.

The inventors have found that the above problems, i.e., the NTC phenomenon occurring after resistance increases, the temperature vs. resistance curve hysteresis and the unstable room-temperature resistance can be substantially eliminated by the combined use of at least two thermoplastic polymer matrices having varying melting points, or at least one thermoplastic polymer matrix and at least one thermosetting polymer matrix, and succeeded in inventing an organic positive temperature coefficient thermistor having excellent performance and high performance stability. The low-melting thermoplastic polymer matrix having a melting point relatively close to that of the low-molecular organic compound starts to melt just after the melting of the low-molecular organic compound, so that the viscosity of the melting component increases thereby suppressing the realignment of the conductive particles. This appears to be the reason that the NTC phenomenon after resistance increases can vanish substantially with a reduced temperature vs. resistance curve hysteresis. By use of the high-melting thermoplastic polymer matrix or the thermosetting polymer matrix, the expansion of the overall system can be suppressed. This appears to be the reason that low room-temperature resistance can be obtained in a stable manner over an extended period of time.

JP-A 59-102940, JP-B's 58-58793 and 62-25694, JP-A 54-16697, JP-B's 4-37557 and 3-67322, JP-A's 62-29085, 62-181347 and 63-307684 (U.S. Pat. No. 2,586,486), JP-B 8-12791 and JP-A 4-306582 disclose an organic positive temperature coefficient thermistor using two or more thermoplastic polymer matrices, and a self control heater using such a thermistor. However, these publications suggest nothing about the use of a low-molecular organic compound at all. The thermistors disclosed are insufficient in terms of hysteresis, and are not suitable for a particular application such as a temperature sensor because, unlike the present invention, any low-molecular organic compound is not used as the active substance. Further, the NTC phenomenon is found after resistance increases. In addition, no tradeoff between low room-temperature resistance and a large rate of resistance change is made because carbon black or the like is used as the conductive particles. JP-A 59-102940 shows that the thermistor is excellent in resistance stability over an extended period of time and performance changes upon repetitive operations are reduced. However, the room-temperature resistance is rather high. The publication are silent about the rate of resistance change and stability upon repetitive operations. The thermistors disclosed in other publications, too, are lower in operating temperature, initial (room-temperature) resistance, performance stability such as the rate of resistance change, and especially in performance stability in high temperature and humidity testing and on-off load testing, as compared with the thermistor of the invention.

EXPLANATION OF THE PREFERRED EMBODIMENTS

Figure 1:
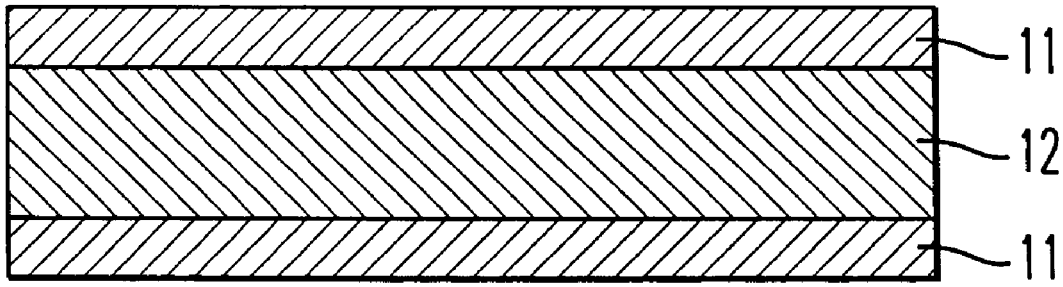
FIG. 1 is a sectional schematic of an organic positive coefficient thermistor.

The present invention will now be explained in detail.

The organic positive temperature coefficient thermistor of the invention comprises at least two thermoplastic polymer matrices having varying melting points, a low-molecular organic compound having preferably a melting point of 40 to 200° C. and conductive particles having spiky protuberances. By the "melting point" used herein is intended an endothermic peak finish temperature as measured by differential scanning calorimetry (DSC).

The thermoplastic polymer matrices used herein may be either crystalline polymers or amorphous polymers. Preferably but not exclusively, polyolefins (inclusive of copolymers) should be used because high performance is obtainable.

The polymers used for the thermoplastic polymer matrices according to the invention, for instance, include:

i) polyolefin (e.g., polyethylene), ii) copolymer composed of monomer units derived from one or two or more olefins (e.g., ethylene, propylene) and an olefinic unsaturated monomer containing one or two or more polar groups (e.g., ethylene-vinyl acetate copolymer, ethylene-acrylic acid copolymer), iii) halogen polymer (e.g., a fluorine polymer such as polyvinylidene fluoride, polytetrafluoroethylene, polyhexafluoropropylene, or a copolymer of theses; and a chlorine polymer such as polyvinyl chloride, polyvinylidene chloride, chlorinated polyvinyl chloride, chlorinated polyethylene, chlorinated polypropylene, or a copolymer of these), iv) polyamide (e.g., 12-nylon), v) polystyrene, vi) polyacrylonitrile, vii) thermoplastic elastomer, viii) polyethylene oxide, polypropylene oxide, and polyacetal, ix) thermoplastic modified cellulose, x) polysulfones, and xi) polyethyl acrylate, and polymethyl (meth)acrylate. More illustratively, use may be made of high-density polyethylene (e.g., Hizex 2100JP (Mitsui Petrochemicals Industries, Ltd., Marlex 6003 (Phillips), and HY540 (Nippon Polychem)), low-density polyethylene (e.g., LC500 (Nippon Polychem), and DYNH-1 (Union Carbide)), medium-density polyethylene (e.g., 2604M (Gulf)), ethylene-ethyl acrylate copolymer (e.g., DPD6169 (Union Carbide)), ethylene-vinyl acetate copolymer (e.g., LV241 (Nippon Polychem)), ethylene-acrylic acid copolymer (e.g., EAA455 (Dow Chemical)), ionomer (e.g., Himyran 1555 (Mitsui-Du Pont Polychemical), polyvinylidene fluoride (Kynar 461 (Elf-Atchem), and vinylidene fluoride-tetrafluoroethylene-hexafluoropropylene copolymer (e.g., Kynar ADS (Elf-Atchem)).

Preferably, such thermoplastic polymers should have a weight-average molecular weight, Mw, of the order of 10,000 to 5,000,000.

In the invention, two or more such thermoplastic polymers are used.

Of the thermoplastic polymers, it is preferable that the melting point of a polymer having the lowest melting point (called the low-melting thermoplastic polymer) is higher than the melting point of the low-molecular organic compound by at least 15° C., and especially 20 to 30° C. If the melting point of the low-melting thermoplastic polymer is higher than this, the effect on a viscosity rise of the melting components then tends to become slender, because the polymer is less susceptible to melting during the melting of the low-molecular organic compound. If the melting point of the low-melting thermoplastic polymer is lower than this, the rapid resistance rise due to the melting of the low-molecular organic compound then tends to become sluggish. It is preferable that the melting point of a high-melting thermoplastic polymer matrix (which refers to a thermoplastic polymer except that having the lowest melting point) is higher than the melting point of the low-molecular organic compound by at least 30° C., and especially 40 to 110° C. If the melting point of the high-melting thermoplastic polymer is higher than this, there is then a possibility that the thermal degradation of the low-molecular organic compound may occur at an elevated milling temperature. If the melting point of the high-melting thermoplastic polymer is lower than this, then it is often difficult to prevent fluidization of the low-molecular organic compound due to its melting, and deformation of a thermistor element when the thermistor is in operation. The difference in melting point between the low-melting thermoplastic polymer and the high-melting thermoplastic polymer should preferably be at least 20° C., and especially 20 to 50° C. It is preferable that the melting point of the low-melting thermoplastic polymer matrix is usually in the range of 60° C. to 130° C. It is also preferable that the melting point of the high-melting thermoplastic polymer matrix is in the range of usually 80 to 200° C., and especially 80 to 150° C.

Preferably, the low-melting thermoplastic polymer matrix should have a melt flow rate or MFR of 1 to 20 g/10 min., and especially 1 to 10 g/10 min., as measured according to the ASTM D1238 definition. A polymer with MFR=1 to 20 g/10 min. has a great effect on the performance stability of the thermistor, because it elevates the viscosity of the melting component upon the melting of the low-molecular organic compound (when the thermistor is in operation), thereby suppressing the realignment of the conductive particles. At a higher MFR, it is difficult to elevate the viscosity of the melting component up to a sufficient level during the melting the low-molecular organic compound; the dispersion state, etc. of the polymer matrices, low-molecular organic compound and conductive particles is susceptible to variations. At a lower MFR, the viscosity of the melting component during the melting of the low-molecular organic compound tends to become too high to achieve the effect of the invention. In addition, the dispersion of the polymer matrices, low-molecular organic compound and conductive particles tends to become difficult.

For the low-melting thermoplastic polymer matrix, it is acceptable to use low-density polyethylene, and olefinic copolymers such as ethylene-vinyl acetate copolymer, ethylene-acrylic acid copolymer, polyethyl acrylate, and polymethyl (meth)acrylate, among which low-density polyethylene, ethylene-vinyl acetate copolymer, and ethylene-acrylic acid copolymer are preferable, with the low-density polyethylene being most preferred.

For the high-melting thermoplastic polymer matrix, it is particularly preferable to use high-density polyethylene because it has a suitable melting point and melt viscosity.

Preferably, the high-density polyethylene should have a melt flow rate or MFR of up to 3.0 g/10 min., and especially up to 1.5 g/10 min., as measured according to the ASTM D1238 definition. A higher MFR makes the performance stability of the thermistor likely to drop due to too low a melt viscosity. The lower limit to MFR is not critical, but should usually be about 0.1 g/10 min.

A polyethylene having a density of 0.910 to 0.929 g/cm$^3$ is referred as a low-density polyethylene, and a polyethylene having a density of 0.942 g/cm$^3$ or greater is called a high-density polyethylene. The low-density polyethylene is produced by a high pressure process, i.e., a high-pressure radical polymerization process carried out at a pressure of at least 1,000 atm., and contains a long-chain branch in addition to a short-chain branch such as an ethylene group. The high-density polyethylene, in a linear chain form, is produced by a coordination anion polymerization process carried out at a medium or low pressure of the order of a few tens of atm., using a transition metal catalyst.

In the practice of the invention, it is acceptable to use three or more thermoplastic polymer matrices having different melting points. However, it is preferable to use a high-density polyethylene with MFR$\leqq$3.0 g/10 min. in combination with a low-density polyethylene or olefinic copolymer with MFR=1 to 20 g/10 min., especially the low-density polyethylene.

The weight ratio between the high-melting thermoplastic polymer matrix and the low-melting thermoplastic polymer matrix, i.e., the weight ratio between the thermoplastic polymer matrix except one having the lowest melting polymer and the thermoplastic polymer matrix having the lowest melting point should preferably be 1:4 to 9:1, and especially 1:3 to 8:1. If the low-melting thermoplastic polymer matrix is used in a larger amount, then the initial resistance stability of the thermistor tends to drop. If the low-melting thermoplastic polymer matrix is used in a smaller amount, then NTC behavior is often found after resistance increases, with a large temperature vs. resistance curve hysteresis.

The present invention also provides an organic positive temperature coefficient thermistor comprising at least one thermoplastic polymer matrix, at least one thermosetting polymer matrix, a low-molecular organic compound that should preferably have a melting point of 40 to 200° C., and conductive particles having spiky protuberances.

The thermoplastic polymer used herein may be the same as explained in conjunction with the use of at least two thermoplastic polymers having varying melting points, and should preferably be the same as the low-melting thermoplastic polymer. In short, the melting point of the thermoplastic polymer should preferably be higher than the melting point of the low-molecular organic compound by at least 15° C., and especially 20 to 30° C., and the ASTM D1238 melt flow rate (MFR) of the thermoplastic polymer matrix should preferably be in the range of 1 to 20 g/10 min., and especially 1 to 10 g/10 min. For the thermoplastic polymer matrix, it is acceptable to use low-density polyethylene, and olefinic copolymers such as ethylene-vinyl acetate copolymer, ethylene-acrylic acid copolymer, polyethyl acrylate, and polymethyl (meth)acrylate, among which low-density polyethylene, ethylene-vinyl acetate copolymer, and ethylene-acrylic acid copolymer are preferable, with the low-density polyethylene being most preferred.

In this case, it is preferable to use the low-density polyethylene or olefinic copolymer having an MFR of 1 to 20 g/10 min., and especially the low-density polyethylene alone, although it is acceptable to use two or more thermoplastic polymer matrices having varying melting points.

Preferably but not exclusively, an epoxy resin, an unsaturated polyester resin, a polyimide, a polyurethane, a phenol resin, and a silicone resin are used for the thermosetting polymer matrix.

An epoxy resin is prepared by curing (crosslinking) an oligomer having a reactive epoxy terminal group (with a molecular weight of a few hundred to about 10,000) using various curing agents, and is broken down into a glycidyl ether type represented by bisphenol A, a glycidyl ester type, a glycidyl amine type, and an alicyclic type. In some applications, a trifunctional or polyfunctional epoxy resin may also be used. Among others, it is preferable to use the glycidyl ether type epoxy resin, with the bisphenol A type epoxy resin being most preferred. Preferably, the epoxy resin used herein has an epoxy equivalent of about 100 to 500. The curing agent is classified into a polyaddition type, a catalyst type and a condensation type depending on the reaction mechanism involved. The polyaddition type curing agent adds to an epoxy or hydroxyl group by itself, and includes polyamine, acid anhydride, polyphenol, polymercaptan, isocyanate, etc. The catalyst type curing agent catalyzes the polymerization of epoxy groups, and includes tertiary amines, imidazoles, etc. The condensation type curing agent condenses with a hydroxyl group for curing, and includes phenol resin, melamine resin, etc. In the invention, it is preferable to use the polyaddition type curing agent, especially a polyamine curing agent and an acid anhydride curing agent as the curing agent for the bisphenol A type epoxy resin. Curing conditions may be properly determined.

Such epoxy resins and curing agents are commercially available, for instance, including Epicoat (resin) and Epicure and Epomate (curing agents), all made by Yuka Shell Epoxy Co., Ltd., and Araldite made by Ciba-Geigy.

An unsaturated polyester resin comprises a polyester (having a molecular weight of about 1,000 to 5,000) composed mainly of an unsaturated dibasic acid or a dibasic acid and a polyhydric alcohol and a crosslinking vinyl monomer in which the polyester is dissolved. Then, the solution is cured using an organic peroxide such as benzoyl peroxide as a polymerization initiator. For curing, polymerization promoters may be used if required. As the starting materials for the unsaturated polyester used herein, maleic anhydride and fumaric anhydride are preferable for the unsaturated dibasic acid, phthalic anhydride, isophthalic anhydride and terephthalic anhydride are preferred for the dibasic acid, and propylene glycol and ethylene glycol are preferred for the polyhydric alcohol. Styrene, diallyl phthalate and vinyltoluene are preferable for the vinyl monomer. The amount of the vinyl monomer may be properly determined. However, it is usually preferred that the amount of the vinyl monomer is about 1.0 to 3.0 mol per fumaric acid residue. To prevent gelation and control curing properties, etc. in the synthesis process, known polymerization inhibitors such as quinones and hydroquinones may be used. Curing conditions may be properly determined.

Such unsaturated polyester resins are commercially available, for instance, including Epolac made by Nippon Shokubai Co., Ltd., Polyset made by Hitachi Kasei Co., Ltd., and Polylight made by Dainippon Ink & Chemicals, Inc.

A polyimide is generally broken down into a condensation type and an addition type depending on preparation processes. In the present invention, however, preference is given to a bis-maleimide type polyimide that is an addition polymerization type polyimide. The bis-maleimide type polyimide may be cured by making use of homopolymerization, a reaction with other unsaturated bond, a Michael addition reaction with aromatic amines, a Diels-Alder reaction with dienes, etc. Particular preference is given to a bis-maleimide type polyimide resin obtained by an addition reaction between bis-maleimide and aromatic diamines. The aromatic diamines include diaminodiphenylmethane, etc. Synthesis, and curing conditions may be properly determined.

Such polyimides are commercially available, for instance, including Imidaloy made by Toshiba Chemical Co., Ltd. and Kerimide made by Ciba-Geigy.

A polyurethane is obtained by a polyaddition reaction between polyisocyanate and polyol. The polyisocyanate is broken down into an aromatic type and an aliphatic type, with the aromatic type being preferred. Preference is given to 2,4- or 2,6-tolylene diisocyanate, diphenylmethane diisocyanate, naphthalene diisocyanate, etc. The polyol includes polyether polyol such as polypropylene glycol, polyester polyol, acryl polyol, etc., with polypropylene glycol being preferred. The catalyst used herein may be an amine type catalyst (a tertiary amine catalyst such as triethylenediamine, and an amine salt catalyst). To this end, however, it is preferable to use an organic metal type catalyst such as dibutyltin dilaurate, and stannous octoate. The catalyst may be used in combination with an subordinate aid such as a crosslinking agent, e.g., polyhydric alcohol, and polyhydric amine. Synthesis, and curing conditions may be properly determined.

Such polyurethane resins are commercially available, for instance, including Sumijule made by Sumitomo Bayer Urethane Co., Ltd., NP series made by Mitsui Toatsu Chemicals, Inc., and Colonate made by Nippon Polyurethane, Co., Ltd.

A phenol resin is obtained by the reaction of phenol with an aldehyde such as formaldehyde, and is generally broken down into a novolak type and a resol type depending on synthesis conditions. The novolak type phenol formed under an acidic catalyst is cured if it is heated together with a crosslinking agent such as hexamethylenetetramine, and the resol type phenol resin formed under a basic catalyst is cured by itself with the application of heat or in the presence of an acidic catalyst. Both types may be used in the invention. Synthesis, and curing conditions may be properly determined.

Such phenol resins are commercially available, for instance, including Sumicon made by Sumitomo Bakelite Co., Ltd., Standlite made by Hitachi Kasei Co., Ltd., and Tecolite made by Toshiba Chemical Co., Ltd.

A silicone resin comprises a repetition of siloxane bonds, for instance, including a silicone resin obtained mainly by the hydrolysis or polycondensation of organohalosiloxane or silicone resins modified by alkyd, polyester, acrylic, epoxy, phenol, urethane, and melamine, silicone rubber obtained by crosslinking linear polydimethylsiloxane or its copolymer with an organic peroxide, etc., and a room-temperature vulcanizing (RTV) condensation or addition type silicone rubber.

Such silicone resins are commercially available, for instance, including various silicone rubbers and various silicone resins made by The Shin-Etsu Chemical Co., Ltd., Toray Dow Corning Co., Ltd., and Toshiba Silicone Co., Ltd.

The thermosetting resins used herein may be properly selected depending on the performance desired for the thermistor and the application of the thermistor. It is particularly preferable to use the epoxy resin and unsaturated polyester resin. Two or more resins may be polymerized together into a polymer.

The weight ratio between the thermosetting polymer matrix and the thermoplastic polymer matrix should preferably be in the range of 1:4 to 9:1, and especially 1:3 to 8:1. If the thermoplastic polymer matrix is used in a larger amount, then the initial resistance stability of the thermistor tends to drop, and if it is used in a smaller amount, then the stability the thermistor at high temperature and humidity tends to become worse.

Although the polymer matrix should preferably be composed of such thermosetting resin (which may have been crosslinked) and thermosetting resin as mentioned above, it is in some cases acceptable to incorporate an elastomer therein.

Preferably but not exclusively, the low-molecular organic compound used herein is a crystalline yet solid (at normal temperature or about 25° C.) substance having a molecular weight of up to about 2,000, preferably up to about 1,000, and more preferably 200 to 800.

Such a low-molecular organic compound, for instance, includes waxes (e.g., petroleum waxes such as paraffin wax and microcrystalline wax as well as natural waxes such as vegetable waxes, animal waxes and mineral waxes), and fats and oils (e.g., fats, and those called solid fats). Actual components of the waxes, and fats and oils may be hydrocarbons (e.g., an alkane type straight-chain hydrocarbon having 22 or more carbon atoms), fatty acids (e.g., a fatty acid of an alkane type straight-chain hydrocarbon having 12 or more carbon atoms), fatty esters (e.g., a methyl ester of a saturated fatty acid obtained from a saturated fatty acid having 20 or more carbon atoms and a lower alcohol such as methyl alcohol), fatty amides (e.g., an amide of an unsaturated fatty amide such as oleic amide, and erucic amide), aliphatic amines (e.g., an aliphatic primary amine having 16 or more carbon atoms), higher alcohols (e.g., an n-alkyl alcohol having 16 or more carbon atoms), and paraffin chloride. However, these components may be used by themselves or in combination as the low-molecular organic compound. The low-molecular organic compound used herein should preferably be selected such that the components can be well dispersed together, while the polarity of the polymer matrix is taken into account. For the low-molecular organic compound the petroleum waxes are preferable.

These low-molecular organic compounds are commercially available, and commercial products may be immediately used.

In the present invention, one object of which is to provide a thermistor that can operate preferably at 200° C. or lower, and especially 100° C. or lower, the low-molecular organic compound used has preferably a melting point, mp, of 40 to 200° C., and preferably 40 to 100° C. Such a low-molecular organic compound, for instance, includes paraffin waxes (e.g., tetracosane $C_{24}H_{50}$ mp 49–52° C.; hexatriacontane $C_{36}H_{74}$ mp 73° C.; HNP-10 mp 75° C., Nippon Seiro Co., Ltd.; and HNP-3 mp 66° C., Nippon Seiro Co., Ltd.), microcrystalline waxes (e.g., Hi-Mic-1080 mp 83° C., Nippon Seiro Co., Ltd.; Hi-Mic-1045 mp 70° C., Nippon Seiro Co., Ltd.; Hi-Mic-2045 mp 64° C., Nippon Seiro Co., Ltd.; Hi-Mic-3090 mp 89° C., Nippon Seiro Co., Ltd.; Seratta 104 mp 96° C., Nippon Sekiyu Seisei Co., Ltd.; and 155 Microwax mp 70° C., Nippon Sekiyu Seisei Co., Ltd.), fatty acids (e.g., behenic acid mp 81° C., Nippon Seika Co., Ltd.; stearic acid mp 72° C., Nippon Seika Co., Ltd.; and palmitic acid mp 64° C., Nippon Seika Co., Ltd.), fatty esters (arachic methyl ester mp 48° C., Tokyo Kasei Co., Ltd.), and fatty amides (e.g., oleic amide mp 76° C., Nippon Seika Co., Ltd.). Use may also be made of polyethylene wax (e.g., Mitsui High-Wax 110 mp 100° C. made by Mitsui Petrochemical Industries, Inc.), stearic amide (mp 109° C.), behenic amide (mp 111° C.), N-N'-ethylene-bis-lauric amide (mp 157° C.), N-N'-dioleyladipic amide (mp 119° C.) and N-N'-hexamethylene-bis-12-hydroxystearic amide (mp 140° C.). Use may further be made of wax blends which comprise paraffin waxes and resins and may further contain microcrystalline waxes, and which have a melting point adjusted to 40 to 200° C.

The low-molecular organic compounds may be used alone or in combination of two or more although depending on operating temperature and so on.

The weight of the low-molecular organic compound used herein should be preferably 0.2 to 4 times, and more preferably 0.2 to 2.5 times, as large as the total weight of the polymer matrices (including the curing agent, etc.). When this mixing ratio becomes lower or the amount of the low-molecular organic compound becomes smaller, no sufficient rate of resistance change is obtainable. When the mixing ratio becomes higher or the amount of the low-molecular organic compound becomes larger, on the contrary, does not only any large deformation of a thermistor element occur upon the melting of the low-molecular organic compound, but it is difficult to mix the low-molecular organic compound with the conductive particles as well.

The organic positive temperature coefficient thermistor of the invention shows an endothermic peak in the vicinities of the melting points of the thermoplastic polymer matrices used and the melting point of the low-molecular organic compound used, as measured in differential scanning calorimetry (DSC). From this it is found that the thermistor has an archipelagic structure wherein the high-melting thermoplastic polymer matrix, low-melting thermoplastic polymer matrix and low-molecular organic compound or the thermosetting polymer matrix, thermoplastic polymer matrix and low-molecular organic compound are independently present.

The conductive particles used herein, each having spiky protuberances, are each made up of a primary particle having pointed protuberances. More specifically, a number of (usually 10 to 500) conical and spiky protuberances, each having a height of ⅓ to 1/50 of particle diameter, are present on one single particle. The conductive particles are preferably made up of metals, and especially Ni.

Although such conductive particles may be used in a discrete powder form, it is preferable that they are used in a chain form of about 10 to 1,000 interconnected primary particles to form a secondary particle. The chain form of interconnected primary particles may partially include primary particles. Examples of the former include a spherical form of nickel powders having spiky protuberances, one of which is commercially available under the trade name of INCO Type 123 Nickel Powder (INCO Co., Ltd.). These powders have an average particle diameter of about 3 to 7 $\mu$m, an apparent density of about 1.8 to 2.7 g/cm$^3$, and a specific surface area of about 0.34 to 0.44 m$^2$/g.

Preferred examples of the latter are filamentary nickel powders, some of which are commercially available under the trade names of INCO Type 255 Nickel Powder, INCO Type 287 Nickel Powder, INCO Type 210 Nickel Powder, and INCO Type 270 Nickel Powder, all made by INCO Co., Ltd., with the former two being preferred. The primary particles have an average particle diameter of preferably at least 0.1 $\mu$m, and more preferably from about 0.5 to about 4.0 $\mu$m inclusive. Primary particles having an average particle diameter of 1.0 to 4.0 μm inclusive are most preferred, and may be mixed with 50% by weight or less of primary particles having an average particle diameter of 0.1 μm to less than 1.0 μm. The apparent density is about 0.3 to 1.0 g/cm$^3$ and the specific surface area is about 0.4 to 2.5 m$^2$/g.

In this regard, it is to be noted that the average particle diameter is measured by the Fischer subsieve method.

Such conductive particles are set forth in JP-A 5-47503 and U.S. Pat. No. 5,378,407.

In addition to the conductive particles having spiky protuberances, it is acceptable to use for the conductive particles carbon conductive particles such as carbon black, graphite, carbon fibers, metallized carbon black, graphitized carbon black and metallized carbon fibers, spherical, flaky or fibrous metal particles, metal particles coated with different metals (e.g., silver-coated nickel particles), ceramic conductive particles such as those of tungsten carbide, titanium nitride, zirconium nitride, titanium carbide, titanium boride and molybdenum silicide, and conductive potassium titanate whiskers disclosed in JP-A's 8-31554 and 9-27383. The amount of such conductive particles should preferably be up to 25% by weight of the conductive particles having spiky protuberances.

The weight of the conductive particles used herein should preferably be 1.5 to 5 times as large as the total weight of the polymer matrices and low-molecular organic compound (the total weight of the organic components inclusive of the curing agent, etc.). When this mixing ratio becomes lower or the amount of the conductive particles becomes smaller, it is impossible to make the room-temperature resistance of the thermistor in a non-operating state sufficiently low. When the amount of the conductive particles becomes larger, on the contrary, it is not only difficult to obtain any large rate of resistance change, but it is also difficult to achieve any uniform mixing, resulting in a failure in obtaining any stable performance.

Next, how to fabricate the organic positive temperature coefficient thermistor of the invention will be explained.

The thermoplastic polymer matrices, low-molecular organic compound and conductive particles may be milled together in known manners at a temperature higher than the melting point of the thermoplastic polymer matrix having the highest melting point, preferably by 5 to 40° C., for about 5 to 90 minutes, using mills, rolls, etc. Alternatively, the thermoplastic polymers and low-molecular organic compound may have been previously mixed together in a molten state or dissolved in a solvent followed by mixing. When the thermoplastic polymer matrices, low-molecular organic compound and conductive particles are mixed together by a solution process, it is preferable to use a solvent in which at least one of the thermoplastic polymer matrices and low-molecular organic compound can be dissolved, and disperse the rest together with the conductive particles in the thus obtained solution.

The milled mixture is pressed into a sheet shape having a given thickness. Press molding may be carried out by an injection process, an extrusion process, etc. After press molding, the sheet is crosslinked together if required. To this end radiation crosslinking, chemical crosslinking using an organic peroxide, and water crosslinking where a silane coupling agent is grafted for a condensation reaction with a silanol group may be used, with the water crosslinking being preferred. Finally, metal electrodes such as Cu or Ni electrodes are thermo-compressed onto the sheet or an electrically conductive paste is coated on the sheet to obtain a thermistor element. Press molding and electrode formation may be carried out at the same time.

In the invention, the mixture of the thermoplastic polymer matrices, low-molecular organic compound and conductive particles is crosslinked together with a silane coupling agent comprising a vinyl group or a (meth)acryloyl group and an alkoxy group to achieve considerable improvements in the performance of the thermistor during storage, and upon repetitive operations.

The performance stability improvement of the organic positive temperature-coefficient thermistor appears to be due to a crosslinked structure of the polymer matrices and the low-molecular organic compound, which allows the polymer matrices to ensure shape retention, thereby suppressing the agglomeration and segregation of the low-molecular organic compound exposed to repetitive melting/solidification cycles when the thermistor is in operation. The coupling agent appears not only to crosslink the above organic matrices, but also to form a chemical bond between the organic and inorganic materials, producing some great effect on the modification of the interface between them. The treatment of the mixture of the polymer matrices, low-molecular organic compound and conductive particles with the silane coupling agent contributes to additional performance stability improvement. This is because there is an increase in the strength of the polymer matrix-conductive particle interface, low-molecular organic compound-conductive particle interface, polymer matrix-metal electrode interface, low-molecular organic compound-metal electrode interface, and low-melting polymer matrix-high-melting polymer matrix interface.

In the invention, the coupling agent is first grafted onto the thermoplastic polymer matrices and low-molecular organic compound via a group having a carbon-carbon double bond (C=C). By alcohol removal in the presence of water and condensation with dehydration, crosslinking reactions then occur according to the following scheme.

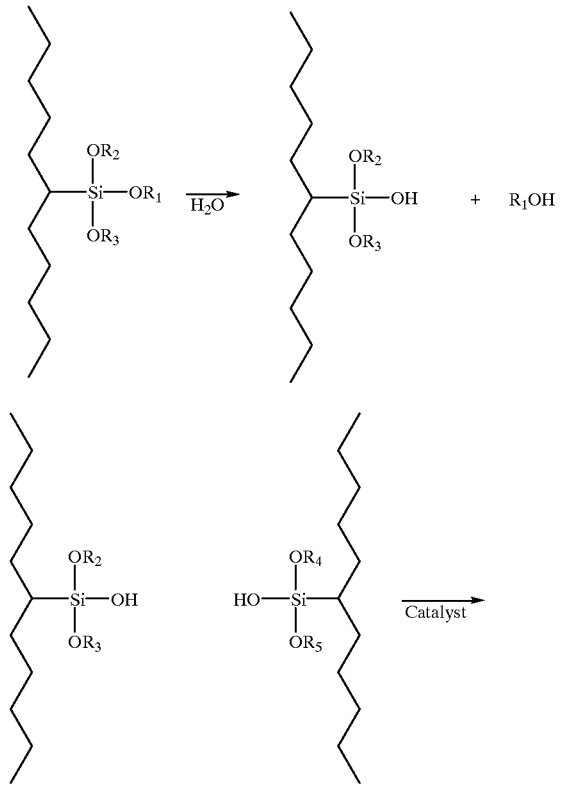

-continued

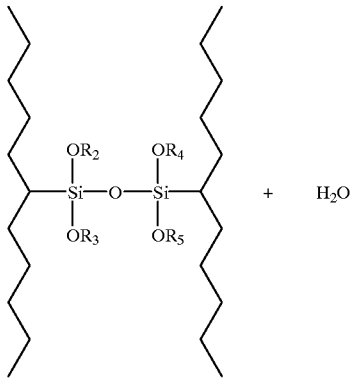

The silane coupling agent may be condensed by alcohol removal and dehydration, and have per molecule an alkoxy group chemically bondable to an inorganic oxide and a vinyl group or a (meth)acryloyl group having an affinity for an organic material or chemically bondable to an organic material. For the silane coupling agent, it is preferable to use trialkoxysilane having a C═C bond.

Preference is given to an alkoxy group having a small number of carbon atoms in general, and a methoxy or ethoxy group in particular. The C═C bond-containing group is a vinyl group or a (meth)acryloyl group, with the vinyl group being preferred. These groups may have been bonded directly or via a carbon chain having 1 to 3 carbon atoms to Si.

A preferred silane coupling agent is liquid at normal temperature.

Exemplary silane coupling agents are vinyltrimethoxysilane, vinyltriethoxysilane, vinyl-tris(β-methoxyethoxy) silane, γ-(meth) acryloxypropyltrimethoxysilane, γ-(meth) acryloxypropyltriethoxysilane, γ-(meth) acryloxypropylmethyldimethoxylsilane and γ-(meth) acryloxypropylmethyldiethyoxysilane, with vinyltrimethoxysiland and vinyltriethoxysilane being most preferred.

For the coupling treatment, the silane coupling agent in an amount of 0.1 to 5% by weight per the total weight of the thermoplastic polymers and low-molecular organic compound is added dropwise to a milled mixture of the thermoplastic polymer matrices, low-molecular organic compound and the conductive particles, followed by full-stirring, and water crosslinking. When the amount of the coupling agent used is smaller than this, the effect of the crosslinking treatment becomes slender. However, the use of the coupling agent in a larger amount does not give rise to any increase in that effect. When the silane coupling agent having a vinyl group is used, an organic peroxide such as 2,2-di-(t-butylperoxy)butane, dicumyl peroxide, and 1,1-di-t-butylperoxy-3,3,5-trimethyl-cyclohexane is incorporated in the coupling agent in an amount of 5 to 20% by weight thereof for grafting onto the organic materials, i.e., the thermoplastic polymers and low-molecular organic compound via the vinyl group. The addition of the silane coupling agent is carried out after the thermoplastic polymers, low-molecular organic compound and conductive particles are milled together in a sufficiently uniform state.

The milled mixture is pressed into a sheet, which is then crosslinked in the presence of water. For instance, the pressed sheet may be immersed in warm water for 6 to 8 hours, using as a catalyst a metal carboxylate such as dibutyltin dilaurate, dioctyltin dilaurate, tin acetate, tin octoate, and zinc octoate. Alternatively, the crosslinking may be carried out at high temperature and humidity while the catalyst is milled with a thermistor element. For the catalyst it is particularly preferable to use dibutyltin dilaurate. Preferably, the crosslinking temperature should be equal to or less than that melting point of the low-molecular organic compound to enhance performance stability upon repetitive operations, etc. After completion of the crosslinking treatment, the sheet is dried, and metal electrodes such as Cu or Ni electrodes are thermocompressed thereto or an electrically conductive paste is coated thereon to prepare a thermistor element.

When the thermosetting resin is used, given amounts of the thermosetting resin (not subjected to curing), curing agent or the like, thermoplastic resin, low-molecular organic compound and conductive particles having spiky protuberances are mixed and dispersed together to obtain a paint form of mixture. Mixing and dispersion may be carried out in known manners using various stirrers, dispersers, mills, paint rolling machines, etc. If air bubbles are incorporated in the mixture, the mixture is then defoamed in vacuum. For viscosity control, various solvents such as aromatic hydrocarbon solvents, ketones and alcohols may be used. The mixture is cast between nickel, copper or other metal foil electrodes or the mixture is coated on such electrodes by means of screen printing, etc., to obtain a sheet. The sheet is cured under given heat-treating conditions for the thermosetting resin. At this time, the thermosetting resin may be pre-cured at a relatively low temperature, followed by curing at a high temperature. Alternatively, the mixture alone may be cured into a sheet form, on which a conductive paste or the like is then coated to form electrodes thereon. The obtained sheet is finally punched out into a desired shape to obtain a thermistor element.

In this case, too, the sheet may be crosslinked if required.

The organic thermistor of the invention may contain various additives provided that they should be undetrimental to the performance intended by the invention. To prevent thermal degradation of the polymer matrices and low-molecular organic compound, for instance, an antioxidant may also be incorporated in the thermistor element. Phenols, organic sulfurs, phosphites (based on organic phosphorus), etc. may be used for the antioxidant.

Additionally, the thermistor of the invention may contain as a good heat- and electricity-conducting additive silicon nitride, silica, alumina and clay (mica, talc, etc.) described in JP-A 57-12061, silicon, silicon carbide, silicon nitride, beryllia and selenium described in JP-B 7-77161, inorganic nitrides and magnesium oxide described in JP-A 5-217711, and the like.

For robustness improvements, the thermistor of the invention may contain titanium oxide, iron oxide, zinc oxide, silica, magnesium oxide, alumina, chromium oxide, barium sulfate, calcium carbonate, calcium hydroxide and lead oxide described in JP-A 5-226112, inorganic solids having a high relative dielectric constant described in JP-A 6-68963, for instance, barium titanate, strontium titanate and potassium niobate, and the like.

For voltage resistance improvements, the thermistor of the invention may contain boron carbide described in JP-A 4-74383, etc.

For strength improvements, the thermistor of the invention may contain hydrated alkali titanate described in JP-A 5-74603, titanium oxide, iron oxide, zinc oxide and silica described in JP-A 8-17563, etc.

As a crystal nucleator, the thermistor of the invention may contain alkali halide and melamine resin described in JP-B 59-10553, benzoic acid, dibenzylidenesorbitol and metal benzoates described in JP-A 6-76511, talc, zeolite and dibenzylidenesorbitol described in JP-A 7-6864, sorbitol derivatives (gelling agents), asphalt and sodium bis(4-t-butylphenyl) phosphate described in JP-A 7-263127, etc.

As an arc-controlling agent, the thermistor of the invention may contain alumina and magnesia hydrate described in JP-B 4-28744, metal hydrates and silicon carbide described in JP-A 61-250058, etc.

As a preventive for the harmful effects of metals, the thermistor of the invention may contain Irganox MD1024 (Ciba-Geigy) described in JP-A 7-6864, etc.

As a flame retardant, the thermistor of the invention may contain diantimony trioxide and aluminum hydroxide described in JP-A 61-239581, magnesium hydroxide described in JP-A 5-74603, a halogen-containing organic compound (including a polymer) such as 2,2-bis(4-hydroxy-3,5-dibromophenyl)propane and polyvinylidene fluoride (PVDF), a phosphorus compound such as ammonium phosphate, etc.

In addition to these additives, the thermistor of the invention may contain zinc sulfide, basic magnesium carbonate, aluminum oxide, calcium silicate, magnesium silicate, aluminosilicate clay (mica, talc, kaolinite, montmorillonite, etc.), glass powders, glass flakes, glass fibers, calcium sulfate, etc.

The above additives should be used in an amount of up to 25% by weight of the total weight of the polymer matrices, low-molecular organic compound and conductive particles.

The organic positive temperature coefficient thermistor of the invention has low initial resistance in its non-operating state, as represented by a room-temperature specific resistance value of about $10^{-3}$ to $10^{-1}$ Ω·cm, and shows a sharp resistance rise upon operation, with the rate of resistance change upon transition from its non-operating state to its operating state being 6 orders of magnitude greater. The performance undergoes little or no degradation even after the passage of 500 hours at 80° C. and 80% RH (corresponding to a humidity-dependent life of 20 years or longer at Tokyo, and 10 years or longer at Naha or even upon on-off load testing.

EXAMPLE

The present invention will now be explained more specifically with reference to examples, and comparative examples.

Example 1

High-density polyethylene (HY540 made by Nippon Polychem Co., Ltd. with an MFR of 1.0 g/10 min. and a melting point 135° C.) was used as the high-melting thermoplastic polymer matrix, and low-density polyethylene (LC 500 mad by Nippon Polychem Co., Ltd. with an MFR of 4.0 g/10 min. and a melting point of 106° C.) as the low-melting thermoplastic polymer matrix. Paraffin wax (HNP-10 made by Nippon Seiro Co., Ltd. with a melting point of 75° C.) was used as the low-molecular organic compound and filamentary nickel powders (Type 255 Nickel Powder made by INCO Co., Ltd.) as the conductive particles. The conductive particles had an average particle diameter of 2.2 to 2.8 μm, an apparent density of 0.5 to 0.65 g/cm$^3$, and a specific surface area of 0.68 m$^2$/g.

The weight ratio between the high-density polyethylene and the low-density polyethylene was 4:1. The nickel powders in an amount of 4 times as large as the total weight of the polyethylene blend was added thereto, and the mixture was milled together at 150° C. in a mill for 5 minutes. The paraffin wax in an amount equal to the total weight of the polyethylene blend, and the nickel powders in an amount of 4 times as large as the weight of the wax were added to and milled with the milled mixture. A silane coupling agent, i.e., vinyltriethoxysilane (KBE1003 made by The Shin-Etsu Chemical Co., Ltd.) in an amount of 0.5% by weight of the total weight of the organic materials, and an organic peroxide, i.e., 2,2-di-(t-butylperoxy)butane (Trigonox D-T50 made by Kayaku Akuzo Co., Ltd.) in an amount of 20% by weight of the silane coupling agent were added dropwise into the milled mixture for a further 60-minute milling.

The obtained mixture was pressed at 150° C. into a 1.1 mm thick sheet by means of a thermo-pressing machine. Then, the sheet was immersed in an aqueous emulsion containing 20% by weight of dibutyltin dilaurate (Tokyo Kasei Co., Ltd.) for an 8-hour crosslinking treatment at 65° C.

The crosslinked sheet was dried in vacuum, and both its sides were then sandwiched between Ni foil electrodes of 30 μm in thickness. Subsequently, the Ni foils were thermo-compressed at 150° C. onto the sheet using a thermo-pressing machine to obtain a compressed sheet having a total thickness of 1 mm. The sheet was then punched out into a disk of 1 cm in diameter to obtain a thermistor element, a section of which is shown in FIG. 1. As can be seen from FIG. 1, a thermistor element sheet 12 that is the milled compressed sheet containing the low-molecular organic compound, two polymer matrices having varying melting points and conductive particles is sandwiched between Ni foil electrodes 11.

Figure 2:
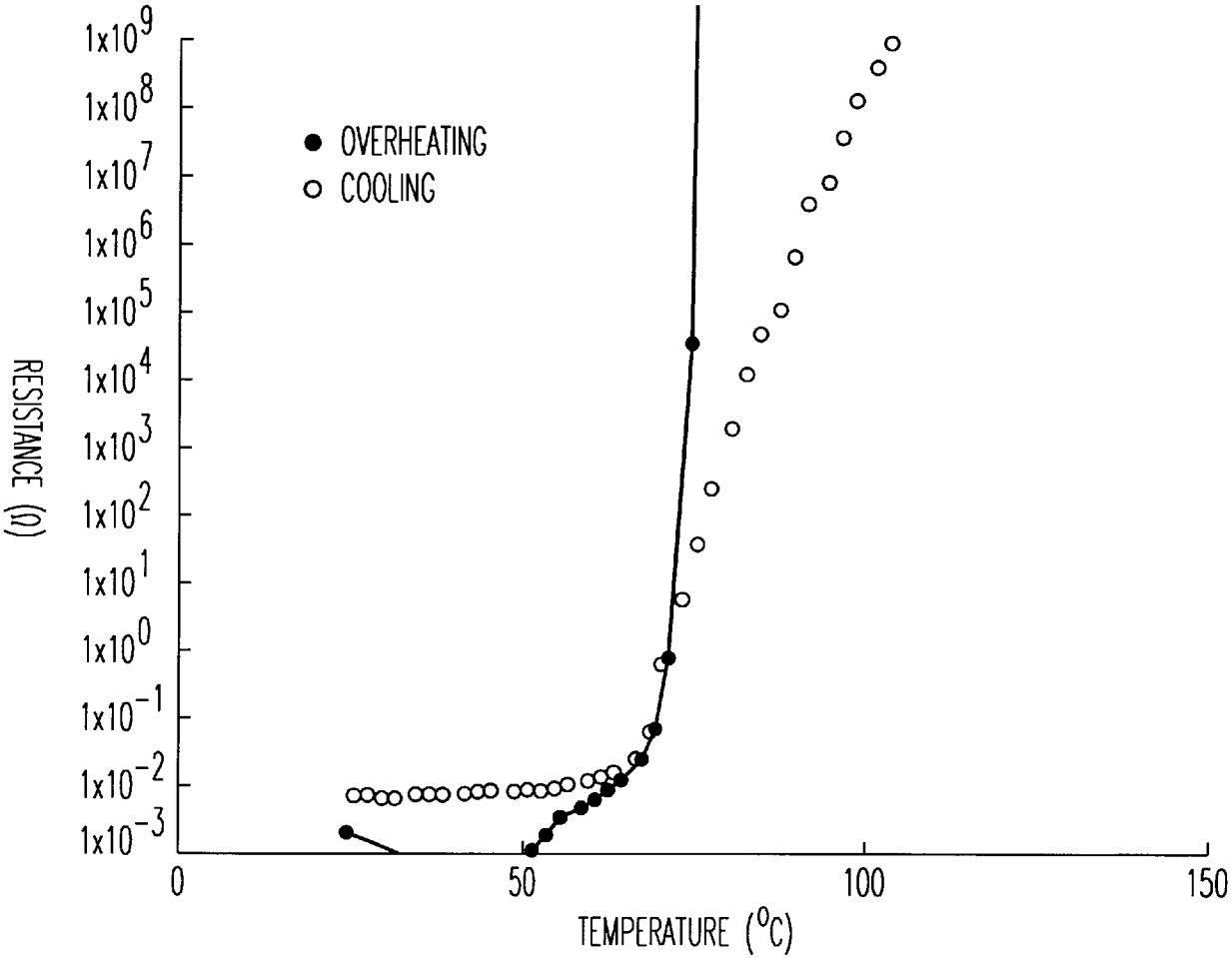
FIG. 2 is a temperature vs. resistance curve for the thermistor element according to Example 1.

In a thermostat the element was heated from room temperature (25° C.) to 120° C. and cooled down from 120° C. to room temperature, each at a rate of 2° C./min., and then measured for resistance value at a given temperature by the four-terminal method to obtain a temperature vs. resistance curve. The results are plotted in FIG. 2.

The element had a room-temperature resistance value of $1.7\times10^{-3}$ Ω ($1.3\times10^{-2}$ Ω·cm), and showed a sharp resistance rise at around the melting point of the paraffin wax, with the rate of resistance change being 11 orders of magnitude greater. Even when the heating of the element was continued to 120° C. after the resistance increase, no resistance decrease (NTC phenomenon) was observed. The temperature vs. resistance curve upon cooling was found to be substantially similar to that upon heating; the hysteresis was sufficiently reduced.

Figure 3:
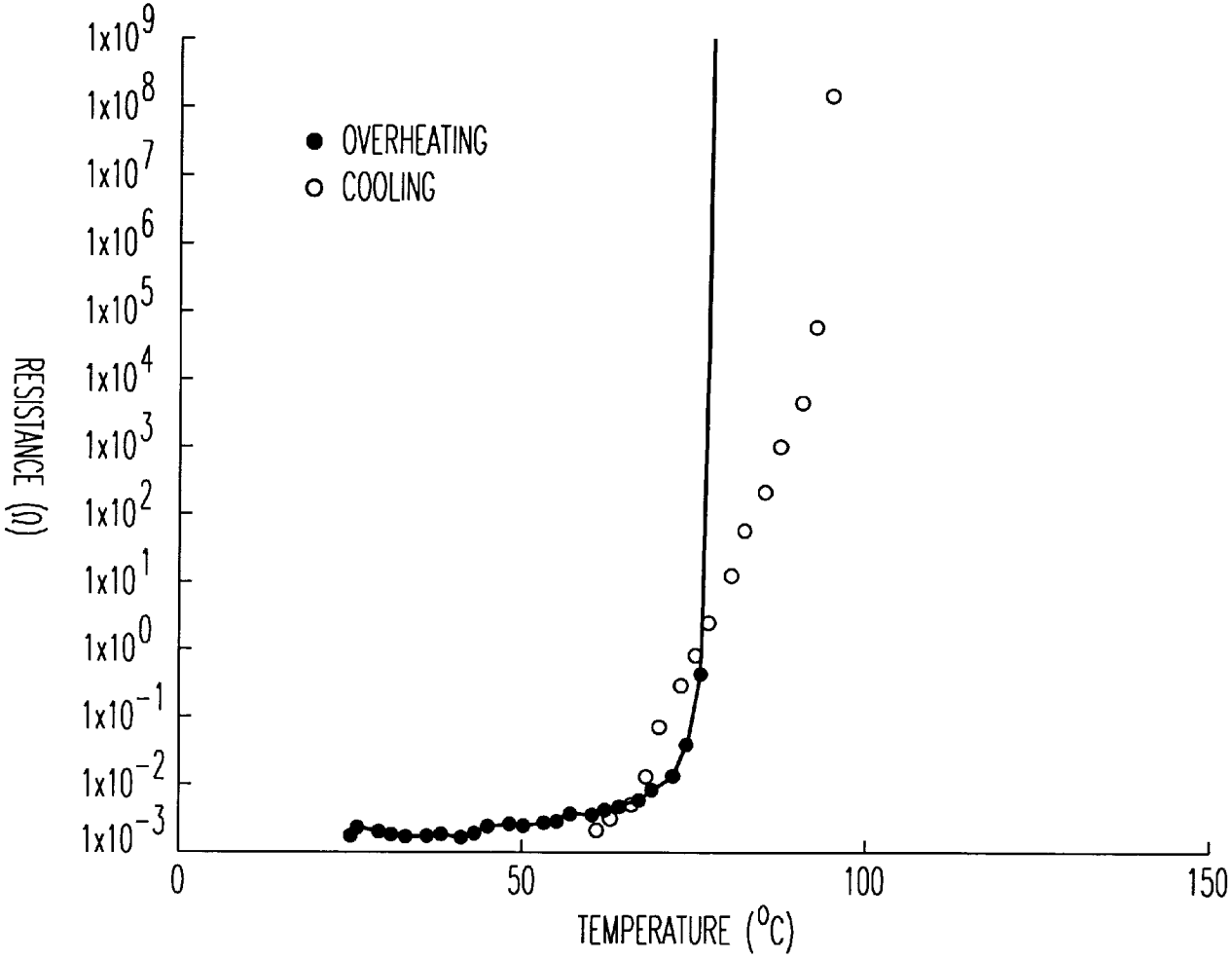
FIG. 3 is a temperature vs. resistance curve for the thermistor element according to Example 1 after subjected to accelerated testing at 80° C. and 80% RH.

This element was left alone in a thermo-hygrostatset at 80° C. and 80% RH for accelerated testing. FIG. 3 is a temperature vs. resistance curve for the element after the passage of 500 hours. The room-temperature resistance value was $8\times10^{-3}$ Ω ($1.4\times10^{-2}$ Ω·cm) or remained substantially unchanged and the rate of resistance change was 11 orders of magnitude greater as well; sufficient PTC performance was kept. No NTC phenomenon was observed whatsoever after the resistance increase, and the profile change between heating and cooling is very limited. This indicates that the hysteresis is sufficiently reduced.

The 500-hour accelerated testing at 80° C. and 80% RH is tantamount to a humidity-dependent operating life of 20 years or longer at Tokyo, and a humidity-dependent operating life of 10 years or longer at Naha, as calculated on an absolute humidity basis. The calculation on an absolute humidity basis is explained with reference to the conversion from the operating life under 80° C. and 80% RH to the operating life under 25° C. and 60% RH conditions. The absolute humidity at 80° C. and 80% RH is 232.5 g/m$^3$ while the absolute humidity at 25° C. and 60% RH is 13.8 g/m$^3$. Here assume the acceleration constant is 2. Then, $(232.5/13.8)^2$ is approximately equal to 283.85. If, in this case, the operating life is 500 hours under the 80° C. and 80% RH conditions, then the operating life under the 25° C. and 60% RH conditions is 500 hours×283.85=141,925 hours=5,914 days=16.2 years It is here to be noted that the year-round humidity at Tokyo and Naha is given by the sum of each average month-long relative humidity as calculated on an absolute humidity basis.

Figure 4:
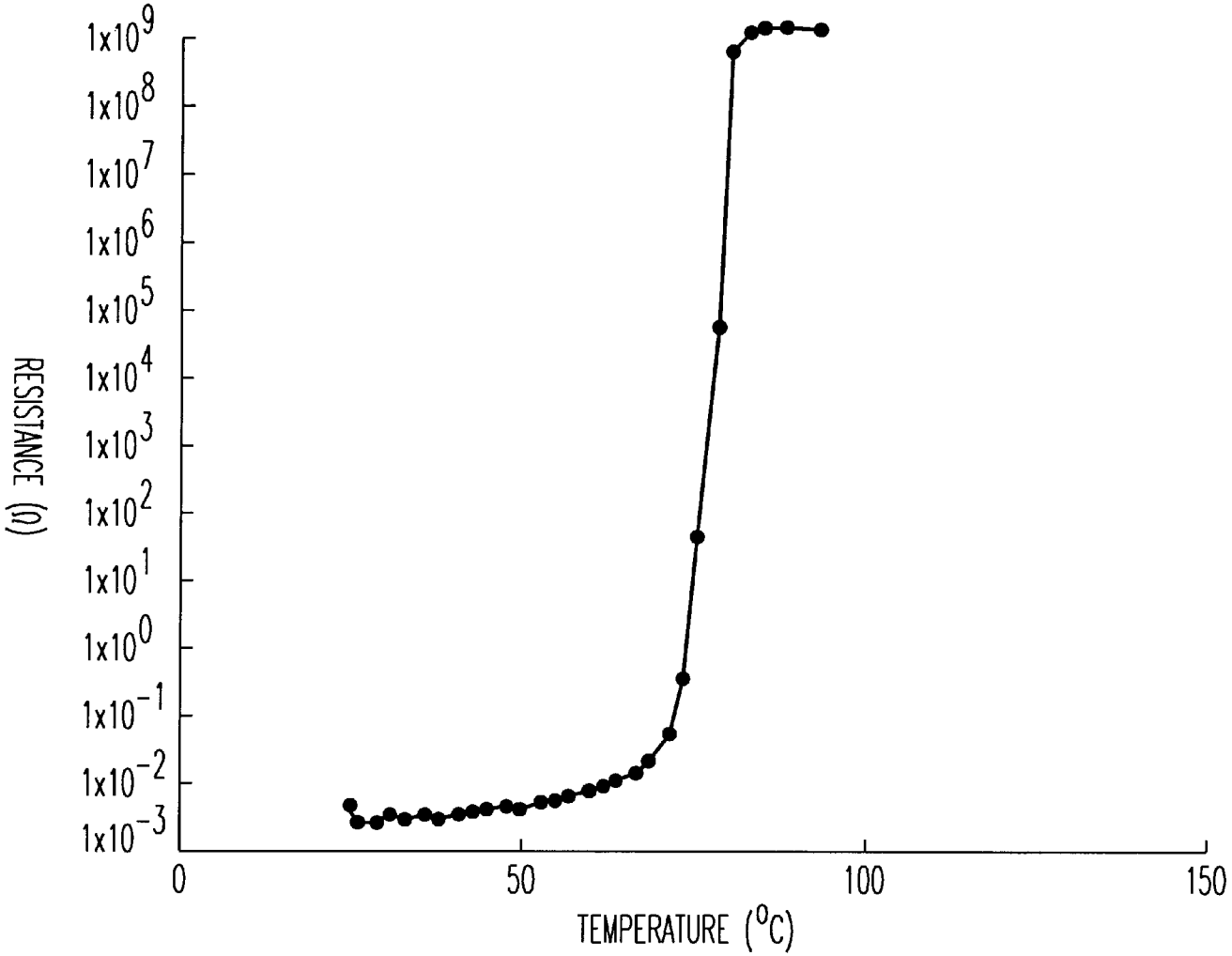
FIG. 4 is a temperature vs. resistance curve for the thermistor element according to Example 1 after subjected to on-off load testing.

On-off load testing was carried out by applying a current of 10 A-5 VDC to the element to energize it for 10 seconds with Joule heat (on condition) and deenergizing it for 30 seconds (off condition). FIG. 4 is a temperature vs. resistance curve for the element after 500 testing cycles. The room-temperature resistance value was $9\times10^{-3}$ Ω ($3.1\times10^{-2}$ Ω·cm) or remained substantially unchanged and the rate of resistance change was 11 orders of magnitude greater as well; sufficient PTC performance was kept. No NTC phenomenon was observed whatsoever after the resistance increase, and the profile change between heating and cooling was very limited, with a sufficiently reduced hysteresis.

Example 2

A thermistor element was obtained as in Example 1 with the exception that ethylene-vinyl acetate copolymer (LV 241 made by Nippon Polychem Co., Ltd. with a vinyl acetate content of 8.0% by weight, an MFR of 1.5 g/10 min. and a melting point of 99° C.) was used as the low-melting thermoplastic polymer matrix and the weight ratio between the high-density polyethylene and the ethyl-vinyl acetate copolymer was 7:3. A temperature vs. resistance curve was obtained and accelerated testing and on-off load testing were carried out as in Example 1.

The element had an initial room-temperature resistance value of $5.0\times10^{-3}$ Ω ($3.9\times10^{-2}$ Ω·cm), and showed a sharp resistance rise at around the melting point of the paraffin wax, with the rate of resistance change being 11 orders of magnitude greater. Even when the heating of the element was continued to 120° C. after the resistance increase, no resistance decrease (NTC phenomenon) was observed. The temperature vs. resistance curve upon cooling was found to be substantially similar to that upon heating; the hysteresis was sufficiently reduced.

In the 80° C. and 80% RH accelerated testing, the room-temperature resistance value after the elapse of 500 hours was $6.5\times10^{-3}$ Ω ($5.1\times10^{-2}$ Ω·cm) or remained substantially unchanged and the rate of resistance change was 11 orders of magnitude greater as well; sufficient PTC performance was kept. No NTC phenomenon was observed whatsoever after the resistance increase, with a sufficiently reduced hysteresis.

In the on-off load testing, the room-temperature resistance value after 500 testing cycles was $7.2\times10^{-3}$ Ω ($5.7\times10^{-2}$ Ω·cm) or remained substantially unchanged and the rate of resistance change was 11 orders of magnitude greater as well; sufficient PTC performance was kept. No NTC phenomenon was observed whatsoever after the resistance increase, with a sufficiently reduced hysteresis.

Example 3

A thermistor element was obtained as in Example 2 with the exception that ionomer (Himyran 1555 made by Mitsui-Du Pont Polychemical Co., Ltd. with an MFR of 10 g/10 min. and a melting point of 96° C.) was used as the low-melting thermoplastic polymer matrix. A temperature vs. resistance curve was obtained and accelerated testing and on-off load testing were carried out as in Example 1.

The element had an initial room-temperature resistance value of $5.5\times10^{-3}$ Ω ($4.3\times10^{-2}$ Ω·cm), and showed a sharp resistance rise at around the melting point of the paraffin wax, with the rate of resistance change being 11 orders of magnitude greater. Even when the heating of the element was continued to 120° C. after the resistance increase, no resistance decrease (NTC phenomenon) was observed. The temperature vs. resistance curve upon cooling was found to be substantially similar to that upon heating; the hysteresis was sufficiently reduced.

In the 80° C. and 80% RH accelerated testing, the room-temperature resistance value after the elapse of 500 hours was $7.0\times10^{-3}$ Ω ($5.5\times10^{-2}$ Ω·cm) or remained substantially unchanged and the rate of resistance change was 11 orders of magnitude greater as well; sufficient PTC performance was kept. No NTC phenomenon was observed whatsoever after the resistance increase, with a sufficiently reduced hysteresis.

In the on-off load testing, the room-temperature resistance value after 500 testing cycles was $8.4\times10^{-3}$ Ω ($6.6\times10^{-2}$ Ω·cm) or remained substantially unchanged and the rate of resistance change was 11 orders of magnitude greater as well; sufficient PTC performance was kept. No NTC phenomenon was observed whatsoever after the resistance increase, with a sufficiently reduced hysteresis.

Example 4

A thermistor element was obtained as in Example 1 with the exception that microcrystalline wax (Hi-Mic-1080 made by Nippon Seiro Co., Ltd. with a melting point of 83° C.) was used as the low-molecular organic compound, and the amount of this wax was 1.5 times as large as the total weight of the high- and low-density polyethylenes. A temperature vs. resistance curve was obtained and accelerated testing and on-off load testing were carried out as in Example 1.

The element had an initial room-temperature resistance value of $3.2\times10^{-3}$ Ω ($2.5\times10^{-2}$ Ω·cm), and showed a sharp resistance rise at around the melting point of the microcrystalline wax, with the rate of resistance change being 8.0 orders of magnitude. Even when the heating of the element was continued to 120 C. after the resistance increase, no resistance decrease (NTC phenomenon) was observed. The temperature vs. resistance curve upon cooling was found to be substantially similar to that upon heating; the hysteresis was sufficiently reduced.

In the 80° C. and 80% RH accelerated testing, the room-temperature resistance value after the elapse of 500 hours was $5.5\times10^{-3}$ Ω ($4.3\times10^{-2}$ Ω·cm) and the rate of resistance change was 7.5 orders of magnitude or remained substantially unchanged; sufficient PTC performance was kept. No NTC phenomenon was observed whatsoever after the resistance increase, with a sufficiently reduced hysteresis.

In the on-off load testing, the room-temperature resistance value after 500 testing cycles was $6.2\times10^{-3}$ Ω ($4.9\times10^{-2}$ Ω·cm) and the rate of resistance change was 7.6 orders of magnitude or remained substantially unchanged; sufficient PTC performance was kept. No NTC phenomenon was observed whatsoever after the resistance increase, with a sufficiently reduced hysteresis.

Comparative Example 1

A thermistor element was obtained as in Example 1 with the exception that the high-density polyethylene, the paraffin wax in an amount of 1.5 times as large as the weight of the high-density polyethylene, and the nickel powders in an amount of 4 times as large as the total weight of the high-density polyethylene and paraffin wax were milled together. A temperature vs. resistance curve was obtained and accelerated testing and on-off load testing were carried out as in Example 1.

Figure 5:
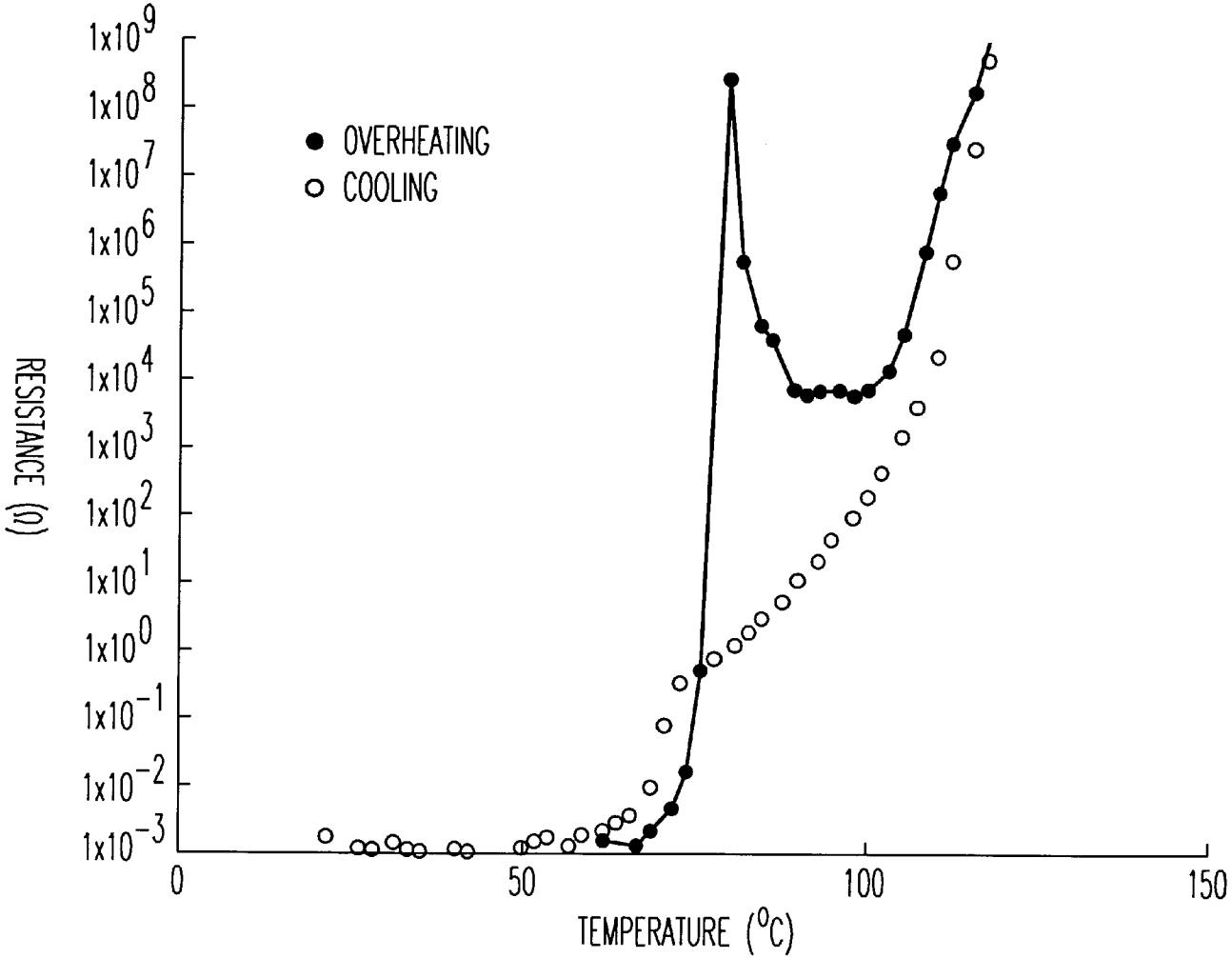
FIG. 5 is a temperature vs. resistance curve for the thermistor element according to Comparative Example 1.

FIG. 5 is a temperature vs. resistance curve for this element. The element had an initial room-temperature resistance value of $4.6\times10^{-4}$ Ω ($3.6\times10^{-3}$ Ω·cm), and showed a sharp resistance rise at around the melting point of paraffin wax, with a rate of resistance change of about 11 orders of magnitude. When the heating of the element was continued to 120° C. after the resistance increase, a large resistance decrease or NTC phenomenon was observed. Upon cooling, the resistance started to decrease from a temperature higher than the operating temperature upon heating by about 40° C.; there was a large hysteresis.

In the 80° C. and 80% RH testing, the increase in the room-temperature resistance was small. However, the rate of resistance change after the passage of 500 hours dropped to about 3 orders of magnitude; significant deterioration in performance was observed.

In the on-off load testing, the increase in the room-temperature resistance was small. However, the rate of resistance change after 500 testing cycles dropped to about 8 orders of magnitude; significant deterioration in performance was observed.

Comparative Example 2

A thermistor element was obtained as in Comparative Example 1 with the exception that low-density polyethylene was substituted for the high-density polyethylene. A temperature vs. resistance curve was obtained and accelerated testing and on-off load testing were carried out as in Example 1.

The element had an initial room-temperature resistance value of $3.0\times10^{-3}$ Ω ($2.4\times10^{-2}$ Ω·cm) and showed a sharp resistance rise at around the melting point of paraffin wax, with a rate of resistance change of 11 orders of magnitude greater.

In the 80° C. and 80% RH accelerated testing, the room-temperature resistance value after the passage of 100 hours increased to $7.0\times10^{-1}$ Ω (5.5 Ω·cm); significant deterioration in performance was observed.

Tabulated in Table 1 are the initial resistance values, room-temperature resistance values after accelerated testing and on-off load testing and rates of resistance change as well as the occurrence of initial NTC phenomenon and the magnitude of hysteresis of the elements obtained in Examples 1 to 4 and Comparative Examples 1 and 2. In Table 1, the white circle indicates that no NTC phenomenon was found with a reduced hysteresis, and the cross indicates that the NTC phenomenon was observed with a large hysteresis.

TABLE 1

| | High-melting polymer | Low-melting polymer | Low-molecular organic compound | Initial: Room-temperature resistance value (Ω) | Initial: Rate of resistance changes (orders of magnitude) | After accelerated testing at 80° C. and 80% RH: Room-temperature resistance value (Ω) | After accelerated testing at 80° C. and 80% RH: Rate of resistance changes (orders of magnitude) | After on-off load testing: Room-temperature resistance value (Ω) | After on-off load testing: Rate of resistance changes (orders of magnitude) | NTC hysteresis |
|---|---|---|---|---|---|---|---|---|---|---|
| Ex. 1 | HDPE mp 135° C., MFR 1.0 g/10 min | LDPE mp 106° C., MFR 4.0 g/10 min | Paraffin wax mp 75° C. | $1.7 \times 10^{-3}$ | ≧11 | $1.8 \times 10^{-3}$ | ≧11 | $3.9 \times 10^{-3}$ | ≧11 | ○ |
| Ex. 2 | HDPE mp 135° C., MFR 1.0 g/10 min | EVA mp 99° C., MFR 1.5 g/10 min | Paraffin wax mp 75° C. | $5.0 \times 10^{-3}$ | ≧11 | $6.5 \times 10^{-3}$ | ≧11 | $7.2 \times 10^{-3}$ | ≧11 | ○ |
| Ex. 3 | HDPE mp 135° C., MFR 1.0 g/10 min | Ionomer mp 96° C., MFR 10 g/10 min | Paraffin wax mp 75° C. | $5.5 \times 10^{-3}$ | ≧11 | $7.0 \times 10^{-3}$ | ≧11 | $8.4 \times 10^{-3}$ | ≧11 | ○ |
| Ex. 4 | HDPE mp 135° C., MFR 1.0 g/10 min | LDPE mp 106° C., MFR 4.0 g/10 min | Microcrystalline wax mp 83° C. | $3.2 \times 10^{-3}$ | ≧8.0 | $5.5 \times 10^{-3}$ | 7.5 | $6.2 \times 10^{-3}$ | 7.6 | ○ |
| Comp. 1 | HDPE mp 135° C., MFR 1.0 g/10 min | None | Paraffin wax mp 75° C. | $4.6 \times 10^{-4}$ | 11 | | 3 | | 8 | X |
| Comp. 2 | None | LDPE mp 106° C., MFR 4.0 g/10 min | Paraffin wax mp 75° C. | $3.0 \times 10^{-3}$ | ≧11 | $7.0 \times 10^{-1}$* | | | | |

HDPE: high-density polyethylene
LDPE: low-density polyethylene
EVA: ethylene-vinyl acetate copolymer
*after 100 hours Example 5

Bisphenol A type epoxy resin (Epicoat 801 made by Yuka Shell Epoxy Co., Ltd.) and a modified amine curing agent (Epomate B002 made by Yuka Shell Epoxy Co., Ltd.) were used as the thermosetting polymer matrix. Low-density polyethylene (LC500 made by Nippon Polychem Co., Ltd. with an MFR of 4.0 g/10 min. and a melting point of 106° C.) was used as the thermoplastic polymer matrix, paraffin wax (HNP-10 made by Nippon Seiro Co., Ltd. with a melting point of 75° C.) as the low-molecular organic compound, and filamentary nickel powders (Type 255 Nickel Powder made by INCO Co., Ltd.) as the conductive particles. The conductive particles had an average particle size of 2.2 to 2.8 $\mu$m, an apparent density of 0.5 to 0.65 g/cm$^3$ and a specific surface area of 0.68 m$^2$/g.

Twenty (20) grams of bisphenol A type epoxy resin, 10 grams of the modified amine curing agent, 8 grams of low-density polyethylene, 38 grams of paraffin wax, 300 grams of nickel powders and 30 ml of toluene were mixed together for about 10 minutes, using a centrifugal disperser. The obtained paint-like mixture was coated on one side of one 30-$\mu$m thick Ni foil electrode, and another Ni foil electrode was placed on the coated mixture. The sheet-like assembly was sandwiched between brass plates using a spacer to a total thickness of 1 mm. This was thermally cured at 80° C. for 3 hours while pressed in a thermo-pressing machine. The thus cured sheet assembly with the electrode thermo-compressed thereto was punched out to a disk of 1 cm in diameter to obtain an organic positive temperature coefficient thermistor element. A temperature vs. resistance curve was obtained and accelerated testing and on-off load testing were carried out as in Example 1.

The element had an initial room-temperature resistance value of $8.2\times10^{-3}$ Ω ($6.9\times10^{-2}$ Ω·cm), and showed a sharp resistance rise at around the melting point of paraffin wax, with the rate of resistance change being 8.2 orders of magnitude. Even when the heating of the element was continued to 120° C. after the resistance increase, no resistance decrease (NTC phenomenon) was observed. The temperature vs. resistance curve upon cooling was found to be substantially similar to that upon heating; the hysteresis was sufficiently reduced.

In the 80° C. and 80% RH accelerated testing, the room-temperature resistance value after the elapse of 500 hours was $8.8\times10^{-3}$ Ω ($6.9\times10^{-2}$ Ω·cm) or remained substantially unchanged and the rate of resistance change was 7 orders of magnitude greater; sufficient PTC performance was kept. No NTC phenomenon was observed whatsoever after the resistance increase, with a sufficiently reduced hysteresis.

In the on-off load testing, the room-temperature resistance value after 500 testing cycles was $7.8\times10^{-3}$ Ω ($6.1\times10^{-2}$ Ω·cm) and the rate of resistance change was 7 orders of magnitude greater; sufficient PTC performance was kept. No NTC phenomenon was observed whatsoever after the resistance increase, with a sufficiently reduced hysteresis.

Example 6

A thermistor element was obtained as in Example 5 with the exception that 30 grams of unsaturated polyester resin (G-110AL made by Nippon Shokubai Co, Ltd.) were used as the thermosetting polymer matrix in place of the bisphenol A type epoxy resin and modified amine curing agent, 0.3 grams of benzoyl peroxide (Kadox B-75W made by Kayaku Akuzo Co., Ltd.) were used as the organic peroxide, and curing was carried out by heating at 80° C. for 30 minutes. By estimation, this thermistor was found to be equivalent to the thermistor element of Example 5.

Example 7

A thermistor element was obtained as in Example 5 with the exception that 20 grams of polyamino-bis-maleimide prepolymer (Kerimide B601 made by Ciba-Geigy) were used as the thermosetting polymer matrix in place of the bisphenol A type epoxy resin and modified amine curing agent, 10 grams of dimethylformamide were used, and curing was carried out at 150° C. for 1 hour and at 180° C. for 3 hours. By estimation, this thermistor was found to be equivalent to the thermistor element of Example 5.

Example 8

A thermistor element was obtained as in Example 5 with the exception that 30 grams of polyurethane (Colonate made by Nippon Polyurethane Kogyo Co., Ltd.) were used as the thermosetting polymer matrix in place of the bisphenol A type epoxy resin and modified amine curing agent, and curing was carried out at 100° C. for 1 hour. By estimation, this thermistor was found to be equivalent to the thermistor element of Example 5.

Example 9

A thermistor element was obtained as in Example 5 with the exception that 30 grams of phenol resin (Sumicon PM made by Sumitomo Bakelite Co., Ltd.) were used as the thermosetting polymer matrix in place of the bisphenol A type epoxy resin and modified amine curing agent, and curing was carried out at 120° C. for 3 hours. By estimation, this thermistor was found to be equivalent to the thermistor element of Example 5.

Example 10

A thermistor element was obtained as in Example 5 with the exception that 30 grams of silicone rubber (TSE3221 made by Toshiba Silicone Co., Ltd.) were used as the thermosetting polymer matrix in place of the bisphenol A type epoxy resin and modified amine curing agent, and curing was carried out at 100° C. for 1 hour. By estimation, this thermistor was found to be equivalent to the thermistor element of Example 5.

Example 11

A thermistor element was obtained as in Example 5 with the exception that 8 grams of ethylene-vinyl acetate copolymer (LV241 made by Nippon Polychem Co., Ltd. with a vinyl acetate content of 8.0% by weight, an MFR of 1.5 g/10 min. and a melting point of 99° C.) were used as the thermoplastic polymer matrix in place of the low-density polyethylene. By estimation, this thermistor was found to be equivalent to the thermistor element of Example 5.

Example 12

A thermistor element was obtained as in Example 5 with the exception that 8 grams of ionomer (Himyran 1555 made by Mitsui-Du Pont Co., Ltd. with an MFR of 10 g/10 min. and a melting point of 96° C.) were used as the thermoplastic polymer matrix in place of the low-density polyethylene. By estimation, this thermistor was found to be equivalent to the thermistor element of Example 5.

EFFECTS OF THE INVENTION

According to the present invention, it is thus possible to provide an organic positive temperature coefficient thermistor that has sufficiently low resistance at room temperature and a large rate of resistance change between an operating state and a non-operating state, and can operate at 100° C. or less, with a reduced temperature vs. resistance curve hysteresis, ease of control of operating temperature, and high performance stability.

What we claim is:

1. An organic positive temperature coefficient thermistor comprising at least two polymer matrices, a low-molecular organic compound and conductive particles, each having spiky protuberances.

2. The organic positive temperature coefficient thermistor according to claim 1, wherein said at least two polymer matrices comprise at least one thermoplastic polymer matrix and at least one thermosetting polymer matrix.

3. The organic positive temperature coefficient thermistor according to claim 2, wherein said thermosetting polymer matrix is any one of an epoxy resin, an unsaturated polyester resin, a polyimide, a polyurethane, a phenol resin, and a silicone resin.

4. The organic positive temperature coefficient thermistor according to claim 1, wherein said at least two polymer matrices comprise at least two thermoplastic polymer matrices having varying melting points.

5. The organic positive temperature coefficient thermistor according to claim 4, wherein of said thermoplastic polymer matrices, a thermoplastic polymer matrix having the lowest melting point is higher in melting point than said low-molecular organic compound by at least 15° C.

6. The organic positive temperature coefficient thermistor according to claim 4, wherein of said thermoplastic polymer matrices, said thermoplastic polymer matrix having the lowest melting point has a melt flow rate of 1 to 20 g/10 min.

7. The organic positive temperature coefficient thermistor according to claim 4, wherein said thermoplastic polymer matrices are polyolefins.

8. The organic positive temperature coefficient thermistor according to claim 4, wherein of said thermoplastic polymer matrices, said thermoplastic polymer matrix having the lowest melting point is a low-density polyethylene.

9. The organic positive temperature coefficient thermistor according to claim 4, wherein said thermoplastic polymer matrices comprises a high-density polyethylene.

10. The organic positive temperature coefficient thermistor according to claim 4, wherein of said thermoplastic polymer matrices, a weight ratio between a thermoplastic polymer matrix other than said thermoplastic polymer matrix having the lowest melting point, and said thermoplastic polymer matrix having the lowest melting point is 1:4 to 9:1.

11. The organic positive temperature coefficient thermistor according to claim 2, wherein a weight ratio between said thermosetting polymer matrix and said thermoplastic polymer matrix is 1:4 to 9:1.

12. The organic positive temperature coefficient thermistor according to claim 1, wherein said low-molecular organic compound has a melting point of 40 to 200° C.

13. The organic positive temperature coefficient thermistor according to claim 1, wherein said low-molecular organic compound has a molecular weight of 2,000 or lower.

14. The organic positive temperature coefficient thermistor according to claim 1, wherein said low-molecular organic compound is a petroleum wax.

15. The organic positive temperature coefficient thermistor according to claim 1, wherein a weight of said low-molecular organic compound is 0.2 to 2.5 times as large as a total weight of said polymer matrices.

16. The organic positive temperature coefficient thermistor according to claim 1, wherein said conductive particles, each having spiky protuberances, are interconnected in a chain form.

17. The organic positive temperature coefficient thermistor according to claim 1, wherein a mixture of said polymer matrices, said low-molecular organic compound and said conductive particles having spiky protuberances is crosslinked together with a silane coupling agent comprising a vinyl group and/or a (meth)acryloyl group and an alkoxy group.

18. The organic positive temperature coefficient thermistor according to claim 17, wherein said silane coupling agent is vinyltrimethoxysilane or vinyltriethoxysilane.

19. The organic positive temperature coefficient thermistor according to claim 1, which has an operating temperature of 100° C. or lower.

* * * * *